United States Patent [19]

Jones

[11] Patent Number: 4,702,368

[45] Date of Patent: Oct. 27, 1987

[54] VERTICALLY SELF SUPPORTING DISPLAY PACKAGE

[75] Inventor: David A. Jones, Dayton, Ohio

[73] Assignee: The Drackett Company, Cincinnati, Ohio

[21] Appl. No.: 934,045

[22] Filed: Nov. 24, 1986

[51] Int. Cl.[4] ..... B65D 5/52

[52] U.S. Cl. ..... 206/45.24; 206/461

[58] Field of Search ..... 206/45.14, 45.31, 461, 206/486, 485, 45.24

[56] References Cited

U.S. PATENT DOCUMENTS

| | | | |
|---|---|---|---|
| 1,598,857 | 9/1926 | Fox et al. | 206/45.24 |
| 3,093,244 | 6/1963 | Middleton, Jr. et al. . | |
| 3,382,970 | 5/1968 | Sellars . | |
| 3,407,928 | 10/1968 | Watts, Jr. . | |
| 3,557,945 | 1/1971 | Gourio . | |
| 3,685,649 | 8/1972 | Diehl . | |
| 3,985,232 | 10/1976 | Johnson . | |
| 4,014,134 | 3/1977 | Womack Jr. | 206/461 |
| 4,549,654 | 10/1985 | Tiesman . | |
| 4,570,787 | 2/1986 | Forbes Jr. . | |

FOREIGN PATENT DOCUMENTS 303117 1/1955 Switzerland .

*Primary Examiner*—Joseph M. Moy
*Attorney, Agent, or Firm*—Gene Warzecha

[57] ABSTRACT

A vertically standing display package formed of a single paperboard blank having a plurality of integrally connected panels joined along a plurality of parallel fold lines. The display package has a single vertical display panel for receiving on one side thereof a product to be displayed. A plurality of parallel substantially rectangular panels formed in one end of the paperboard blank are folded into a generally rectangular frame at the bottom of the vertical display surface. The frame extends to the same side of the vertical display panel as the product.

6 Claims, 5 Drawing Figures

22
14
15
16
18
20
30
32
34
36
38
40
42
44
50
54
56
58
88
92
94
96
98

VERTICALLY SELF SUPPORTING DISPLAY PACKAGE

BACKGROUND OF THE INVENTION

1 FIELD OF THE INVENTION

The invention relates to self-supporting, free-standing display packages for displaying a product. More particularly, the invention relates to a package formed from a single paperboard blank having a plurality of panels adapted to be bent along connecting fold lines to form a vertically free-standing structure.

2 DESCRIPTION OF THE PRIOR ART

Numerous packaging concepts are known in the prior art for displaying a variety of products in many different ways. The choice of packaging concept depends greatly upon the ultimate effect which is desired to be presented to the consumer.

This invention relates to those types of situations and produots where it is desired to present products to the consumer in a plurality of independent packages each free-standing vertically on a horizontal support surface. The package produced in accordance with this invention is particularly suited to encasing the product in a transparent blister package to make it visible to the consumer Examples of paperboard panels used to display products encased in a blister package are shown U.S. Pat. No. 3,382,970 (Sellors) and 4,549,654 (Tiesman). Each of these display packages, however, requires two layers of paperboard between which the blister package is secured. This results in a package which permits the product to be displayed from either side but which is unnecessarily costly for certain products where display is only needed on one side of the package.

Another vertical display package is shown in U.S. Pat. No. 3,685,649 (Diehl). While this patent discloses a package construction enabling a preformed transparent pocket to be extending to one side of the package, this package construction also requires two layers of paperboard. Additionally, this package construction requires a relatively wide base extending to the front and back of the central panel. This construction occupies an excessive amount of shelf space thereby limiting the number of products that may be simultaneously displayed in a given area.

A stand up blister package shown in U.S. Pat. No. 3,093,244 (Middleton, Jr. et al) utilizes a front blister package secured to a paperboard backing and achieves the stand up feature by bending the bottom portion of the blister package and paperboard to create a horizontal surface which cooperates with the bottom of the blister pocket to support the package. This construction also utilizes an excessive amount of shelf space.

In some blister packages which are vertically supported by a bent foot portion of the blister material, manufacturing tolerances result in final packages which do not consistently stand vertically. The positioning of the blister material on the paperboard backing may deviate within the manufacturing tolerances so that when the foot portion is bent, it is not always bent in the same position relative to the paperboard back. Some final packages will therefore lean forward or backward. This results in an uneven and unaesthetic display for the consumer. It is, therefore, one object of this invention to provide a blister package which may be consistently produced to stand vertically.

It is another object of this invention to overcome the foregoing disadvantages of the prior art by providing a self-supporting display package for displaying a product encased in a blister package in a vertical orientation.

It is an additional object of this invention to provide a self-supporting display package for displaying a product in a vertical orientation while occupying a minimum amount of shelf space.

It is a further object of this invention to provide a single paperboard panel which may be folded in a predetermined manner to produce a vertically free-standing paperboard panel to one side of which a product may be secured.

SUMMARY OF THE INVENTION

These and other objects of this invention are achieved by the preferred embodiment disclosed herein which is a self-supporting display package having a single vertical panel for receiving on one side thereof a product to be displayed, comprising: a plurality of panels integrally formed with the bottom of said vertical panel, said panels joined to each other and to said vertical panel along respective parallel fold lines and foldable into a substantially open frame adjacent the bottom of said vertical panel, said frame extending to said one side of said vertical panel; and locking tabs foldably joined to one of said plurality of panels, said locking tabs being foldable into a vertical orientation within said frame to retain the shape thereof. A product to be displayed may be encased within a blister package adhesively secured to the display side, i.e. frame side, of the vertical panel.

DESCRIPTION OF THE PREFERRED EMBODIMENT

Figure 1:
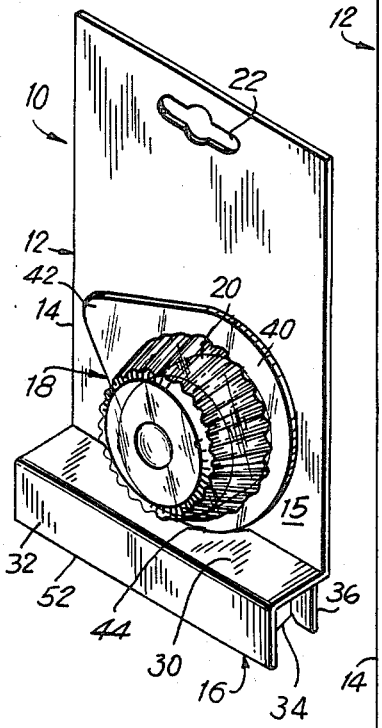
FIG. 1 shows a perspective view of the invention as it would appear in a display mode.

Referring now to FIG. 1, there is shown a paperboard/blister package 10 embodying the principles of this invention. Package 10 is formed from a single paperboard blank 12 having a plurality of fold lines and cut lines arranged in a manner to be described below. Package 10 includes a vertical display panel 14 having a front display surface 15 supported by a rectilinear frame or base 16. A blister pocket 18 containing a product 20 is adhesively secured to display surface 15. The paperboard must be of sufficient thickness to enable display panel 14 to stand vertically under the weight of a product. The depth of base 16 should be comparable to the depth of product 20 in order to prevent package 10 from falling over while not making the base excessively deep so as to occupy unnecessary shelf space. Package 10 also includes a precut (but not necessarily punched out) aperture portion 22 to enable the package to be hung if so desired.

Figure 5:
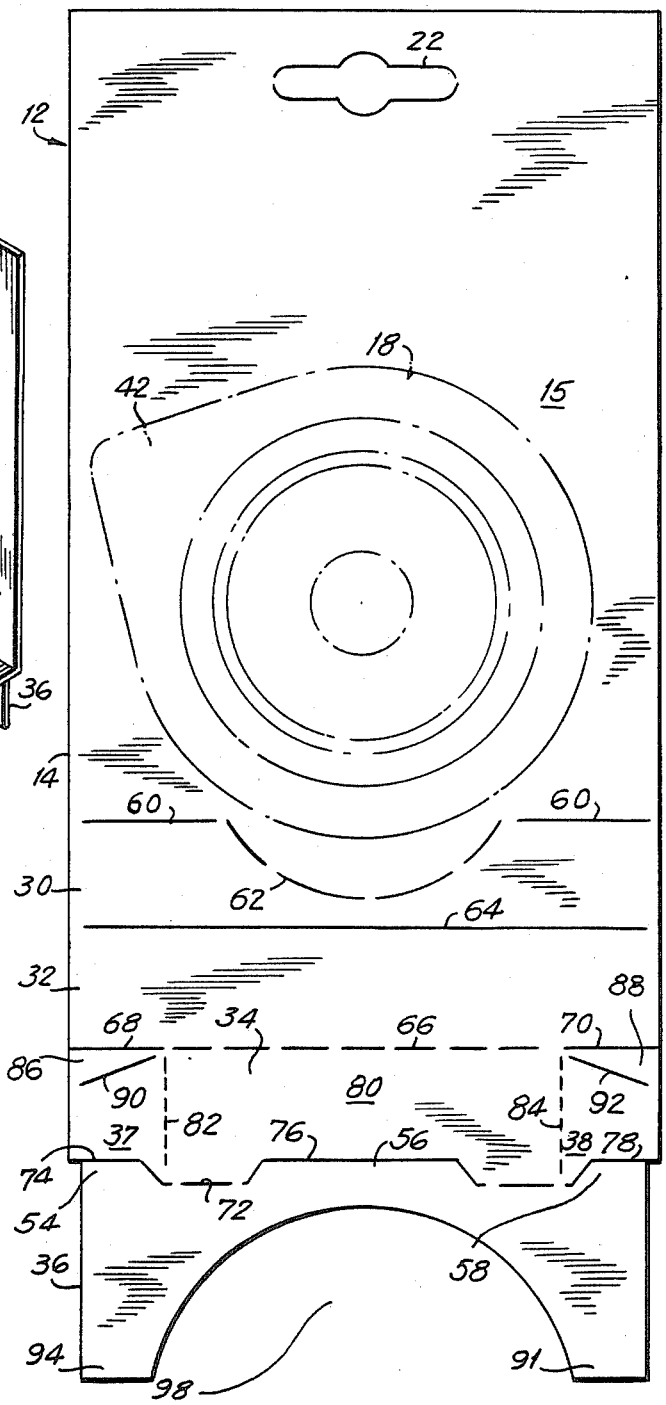
FIG. 5 is a plan view of the paperboard panel of the invention showing the various fold lines required to achieve the advantages of the structure shown in FIG. 1.

Rectilinear base 16 comprises four integrally connected panels 30, 32, 34 and 36 all being part of paperboard blank 12 as best seen in FIG. 5. Base 16 is hollow with the exception of a pair of locking tabs 37 and 38 which fold into the base 16 to help retain its shape.

Figures 2, 3, 4:
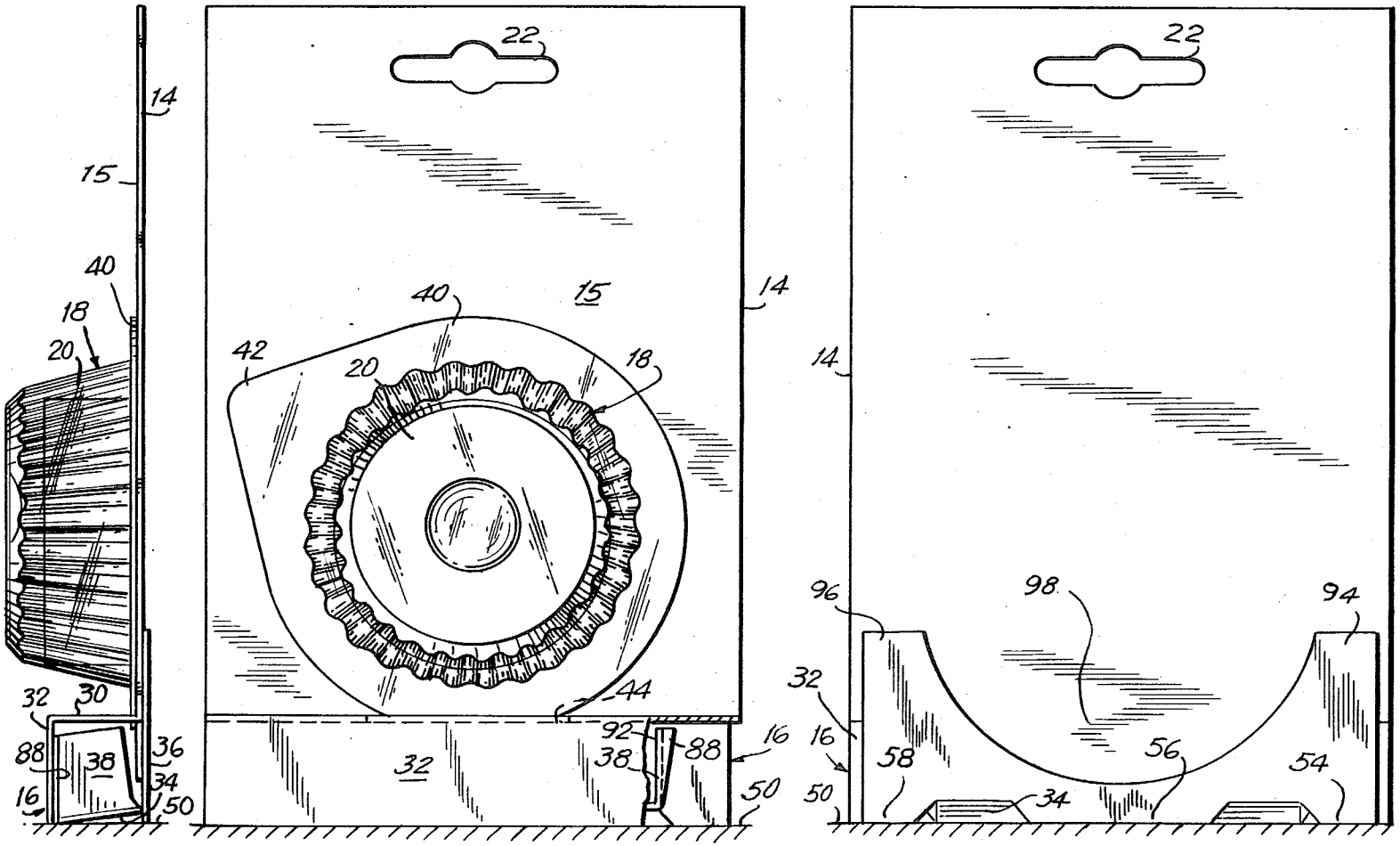
FIG. 2 is a front elevational view of FIG. 1.
FIG. 3 is a right side elevational view of FIG. 1.
FIG. 4 is a rear elevational view of FIG. 1.

Referring now to FIGS. 2 and 3, showing front and side elevational views of FIG. 1, it will be noted that blister pocket 18 and product 20 are on the same side of display panel 14. The only portion of base 16 connected to the rear of panel 14 is a portion of panel 36 as will be better understood below. In the preferred embodiment, product 20 is a tabletted or extruded toilet bowl cleaner which, because of the construction of pocket 18 and the relative sizes of pocket 18 and product 20 may rest near the bottom of pocket 18 as best seen in FIG. 3. Blister package 18 has a peripheral sealing surface 40 and a pull tab 42. To maintain stability of the package in use, blister pocket 18 and product 20 are situated as close to base 16 as possible to provide a low center of gravity. A semi-circular cut out 44 is provided in panel 30 to enable sealing surface 40 to be positioned low on display surface 15.

Package 10 may be more consistently manufactured to stand vertically than prior art free-standing packages. Rectangular base 16 rests upon horizontal surface 50 along a front edge 52 and three rear feet 54, 56 and 58. The formation of the rear feet and the consequent inclination of panel 34 (as best seen in FIG. 3) is preferred in order to consistently produce a vertically standing package. An alternative might be to have the rear feet replaced by a rear edge comparable to front edge 52. However, because of the varying characteristics of paperboard the exact position of a fold line is not easy to predict. Therefore, resting package 10 on leading edge 52 and a parallel rear edge would not consistently produce a vertically standing package.

Referring now to FIG. 5, a plan view of a single paperboard blank 12 is shown with the various panels and fold lines in their relative positions. Panel 14 having display surface 15 is connected to panel 30 along a fold line 60 which has a central semi-circular cut portion 62. It will be understood that when panel 12 is folded, cut portion 62 produces cut out 44. Panel 30 is connected to panel 32 along fold line 64. Panel 34 is connected to panel 32 along fold line 66 which has at each end thereof cut portions 68 and 70. Panel 34 is connected to panel 36 along fold line 72 which is cut through in portions 74, 76 and 78. Panel 34 is provided at either end with a pair of locking tabs 37 and 38 connected to the central portion 80 along transverse fold lines 82 and 84. Locking tabs 37 and 38 are provided with small triangular flap portions 86 and 88, respectively, which are connected to their associated locking tabs along fold lines 90 and 92. Panel 36 has a pair of extensions 94 and 96 which, as best seen in FIG. 4, are folded back and adhesively secured to the rear of panel 14. Panel 36 is thus provided with a cut out portion 98 which not only serves to decrease the amount of paperboard required to produce package 10, but also increases the visible surface area of the rear of panel 14 (available for product instructions or other display information) and facilitates heat sealing of surface 40 by reducing the paperboard thickness through which conventional heat sealing equipment must operate.

It will be easily understood by those skilled in the art how the various panels may be folded to produce the structure shown in FIG. 1. However, to clarify the function of locking tabs 37 and 38, a portion of FIG. 2 is cut away in order to show the relative position of one of the locking tabs relative to frame 16.

It will be understood by those skilled in the art that numerous modifications and embodiments may be made to the preferred embodiment of the invention disclosed herein without departing from the spirit and scope thereof.

What is claimed is:

1. A self-supporting display package having a single vertical panel for receiving on one side thereof a product to be displayed, said product being secured to said panel in order to be at a predetermined height above the surface supporting said package, said package comprising:

a plurality of panels integrally formed with the bottom of said vertical panel, said panels joined to each other and to said vertical panel along respective parallel fold lines and foldable into a substantially open frame adjacent the bottom of said vertical panel, said frame extending to said one side of said vertical panel below said product; and a locking tab foldably joined to each end of one of said plurality of panels, said locking tab being foldable about a substantially horizontal fold line into a vertical orientation within said frame to retain the shape thereof.

2. A self-supporting display package according to claim 1 wherein said frame is a hollow substantially rectangular prism.

3. A self-supporting display package according to claim 2 wherein said rectangular frame has a depth approximately equal to the depth of the product.

4. A paperboard blank for forming a self-supporting display package for displaying a product in a vertical orientation, said paperboard blank comprising:

a first panel for being supported vertically;

a second panel joined to one end of said first panel via a first horizontal fold line, said second panel being substantially rectangular and joined to said first panel along one long side of said second panel;

a third rectangular panel joined along one long side thereof to the opposite long side of said second panel via a second horizontal fold line, said second fold line parallel to said first fold line;

a fourth substantially rectangular panel joined along one long side thereof to the opposite long side of said third panel via a third horizontal fold line, said third fold line parallel to said second fold line;

a locking tab joined to each narrow end of said fourth panel via a respective pair of fourth and fifth fold lines each transverse to said third fold line; and a fifth substantially rectangular panel joined along one long side thereof to the opposite long side of said fourth panel via a sixth horizontal fold line, said sixth fold line parallel to said third fold line whereby said display package may be made vertically self-supporting by folding said second panel forward about said first fold line, folding said third panel downward about said second fold line, folding said fourth and fifth panels backward about said third and sixth fold lines, respectively, securing said fifth panel to the back of said first panel, and folding said locking tabs inwardly.

5. A self-supporting display package according to claims 1 or 4 wherein said locking tabs are folded upwardly into operating position and wherein the tabs each have a support portion connected thereto via a fold line for enabling said support portion to lie parallel to one of said panels.

6. A self-supporting display package according to claim 4 wherein said fifth panel has a pair of extensions extending away from said sixth fold line to provide an open space between said extensions.

* * * * *